US005357413A

United States Patent [19]

Mandall

[11] Patent Number: 5,357,413

[45] Date of Patent: Oct. 18, 1994

[54] ARMORED LIGHTING FIXTURE

[76] Inventor: Michael C. Mandall, 5442 E. Cambridge Ave., Phoenix, Ariz. 85018

[21] Appl. No.: 58,032

[22] Filed: May 7, 1993

[51] Int. Cl.[5] ..... F21V 7/00

[52] U.S. Cl. ..... 362/300; 362/306; 362/346; 362/369; 362/376; 362/390

[58] Field of Search ..... 362/298, 299, 300, 301, 362/302, 306, 296, 346, 347, 369, 390, 433, 288, 389, 376

[56] References Cited

U.S. PATENT DOCUMENTS

| | | | |
|---|---|---|---|
| 1,814,669 | 7/1931 | Cushing | 362/299 |
| 1,827,141 | 10/1931 | Cushing | 362/347 |
| 1,881,525 | 10/1932 | Halpern | 362/433 |
| 1,950,130 | 3/1934 | Barlow et al. | 362/347 |
| 2,125,635 | 8/1938 | Hobart | 362/298 |
| 2,949,598 | 8/1960 | Bush | 362/433 |
| 3,270,194 | 8/1966 | Lee | 362/218 |
| 3,404,886 | 10/1968 | Dundr | 362/296 |
| 4,150,422 | 4/1979 | Peralta et al. | 362/218 |
| 4,352,148 | 9/1982 | McJunkin, Jr. et al. | 362/369 |
| 5,105,347 | 4/1992 | Ruud et al. | 362/300 |

FOREIGN PATENT DOCUMENTS

| | | | |
|---|---|---|---|
| 550313 | 5/1932 | Fed. Rep. of Germany | 362/301 |

*Primary Examiner*—Ira S. Lazarus
*Assistant Examiner*—Alan Cariaso
*Attorney, Agent, or Firm*—Cahill, Sutton & Thomas

[57] ABSTRACT

An armored housing with a top opening protects a lamp positioned inside against projectiles. The lamp preferably is carried by a first reflector structure which is resiliently suspended inside the housing to isolate the first reflector structure and the lamp from the shock of projectiles hitting the housing. The second reflector structure positioned above the housing receives light from the lamp and the first reflector structure and reflects that light downwardly and outwardly past the housing and over a wide area.

7 Claims, 3 Drawing Sheets

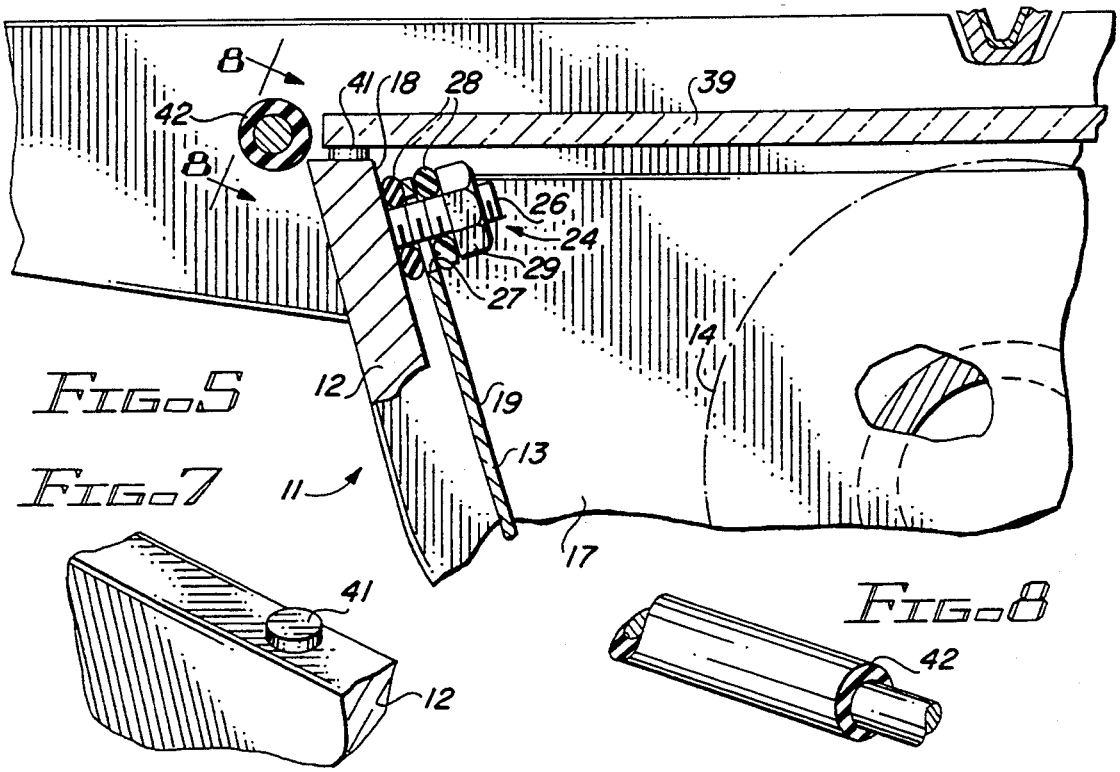
FIG. 5
FIG. 7
FIG. 8
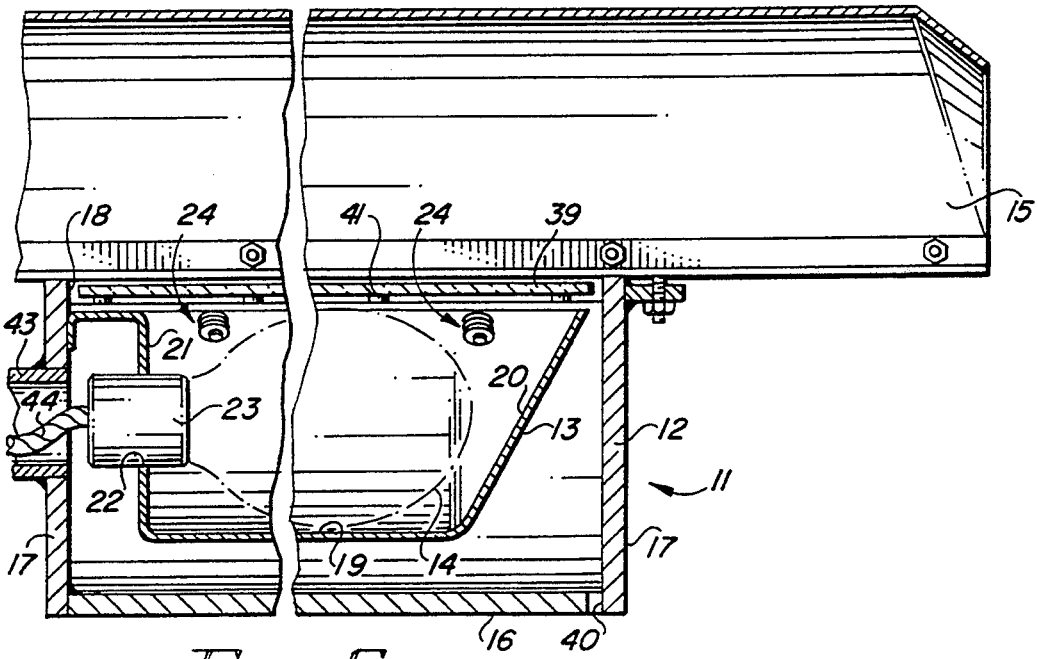
FIG. 6

ARMORED LIGHTING FIXTURE

TECHNICAL FIELD

This invention is concerned with providing reliable outdoor illumination of areas subject to vandalism. Specifically, the invention provides a lighting fixture in which the lamp therein is protected by armor against firearms projectiles.

BACKGROUND ART

Outdoor lighting fixtures are frequently subjected to breakage by criminal activities. Often, vandals will seek to extinguish the light merely for sport by throwing rocks or launching other projectiles, such as bullets fired from guns. Or, criminals may seek to extinguish the light to permit them to carry out other criminal activities, such as theft, undetected.

Other inventors have devised fixtures for protecting electric lamps from firearms projectiles. U.S. Pat. No. 4,150,422, granted Apr. 17, 1979, to E. B. Peralta, et al. for "Armored Light Projector" discloses one such fixture. The Peralta fixture, however, is designed to project a frontal beam of light which is not well suited for illuminating a large area.

O. J. Dundr in his U.S. Pat. No. 3,404,886, granted Oct. 8, 1968, for "Bullet Deflecting Device" discloses an arrangement for deflecting stray bullets away from a lamp employed to illuminate a target. Again, the arrangement there disclosed does not address the problem of illuminating a large area.

Of course, it is known to employ reflective mirror systems to direct light from a single small area source over a much larger area. U.S. Pat. No. 3,270,194, granted Aug. 30, 1966, to P. K. Lee for "Light Exposure Apparatus" shows how this principle can be applied to a photocopying light-box.

There remains a need for a reliable outdoor lighting fixture which can be employed to illuminate a large area and which will resist efforts to destroy it.

DISCLOSURE OF THE INVENTION

This invention meets this need by combining several features into the lighting fixture. First, there is provided a housing formed of armor plate for protecting a lamp situated inside. The housing is open at the top to permit light to be emitted but has closed sides and a bottom to fend off projectiles fired from beneath the fixture.

The housing also preferably has a first reflector structure resiliently suspended therein. The lamp of the fixture is positioned within this first reflector structure. In a preferred embodiment, the lamp is mounted directly onto the first reflector structure so that both the lamp and the reflector structure are isolated by the reflector structure's resilient suspension from the shocks of projectiles striking the housing.

The lighting fixture further comprises a second reflector structure positioned above the housing. This second reflector structure receives light from the lamp and the first reflector structure and directs that light downwardly and outwardly past the housing to illuminate a large area.

BRIEF DESCRIPTION OF THE DRAWINGS

The invention is described in greater detail hereinafter by reference to the accompanying drawings, wherein:

FIG. 5 is an enlarged detail generally of the area of FIG. 2 indicated by dot-and-dash circle 5;

FIG. 6 is a longitudinal sectional view through the fixture taken generally as indicated by the line 6—6 in FIG. 2;

FIGS. 7 and 8 are enlarged details of resilient mounting means for a glass housing cover employed in the fixture;

BEST MODES FOR CARRYING OUT THE INVENTION

Figure 1:
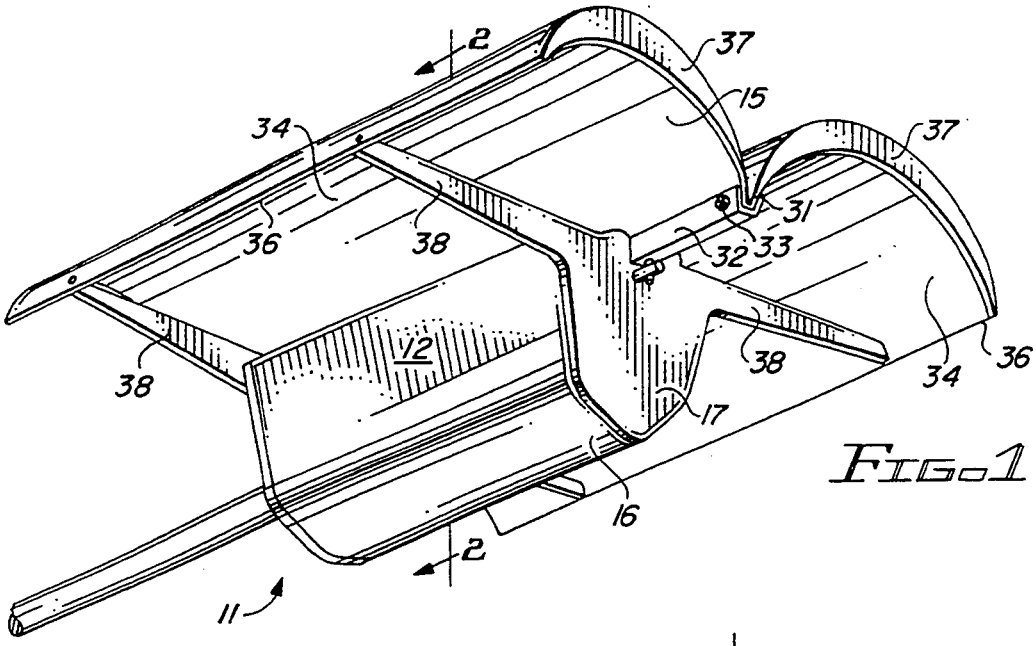
FIG. 1 is a perspective view of a lighting fixture constructed in accordance with this invention.
Figure 2:
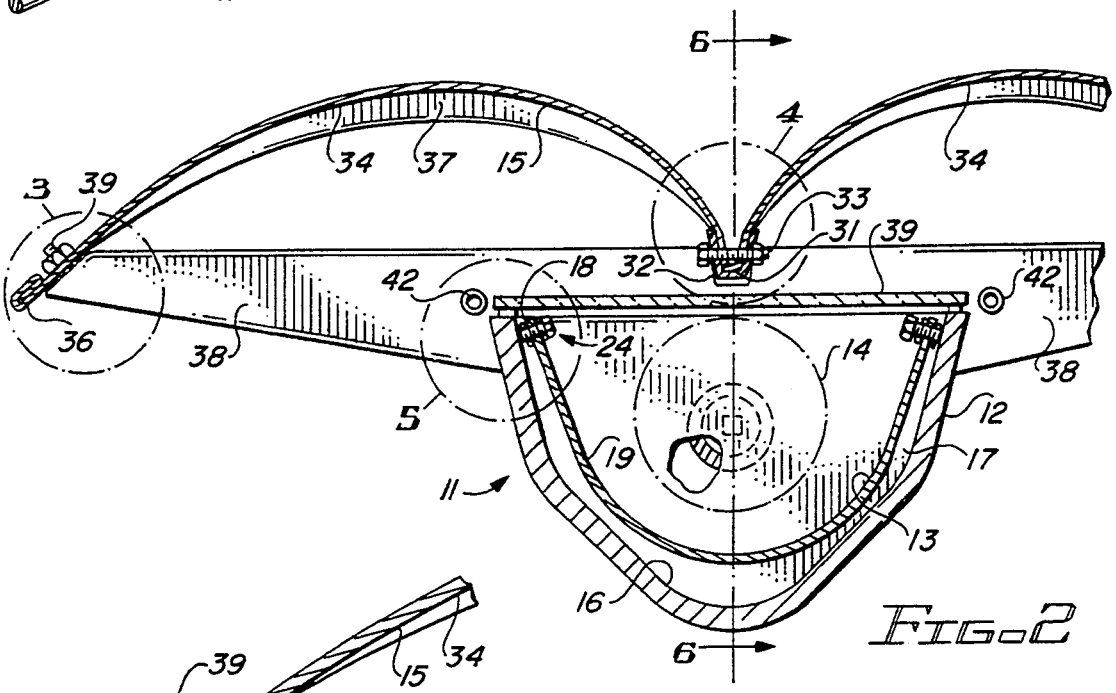
FIG. 2 is a partial transverse sectional view of the fixture taken generally as indicated by line 2—2 in FIG. 1.
Figure 3:
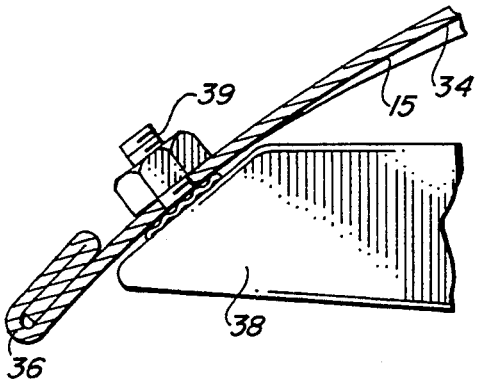
FIG. 3 is an enlarged detail of the area of FIG. 2 encompassed by the dot-and-dash circle 3.
Figure 4:
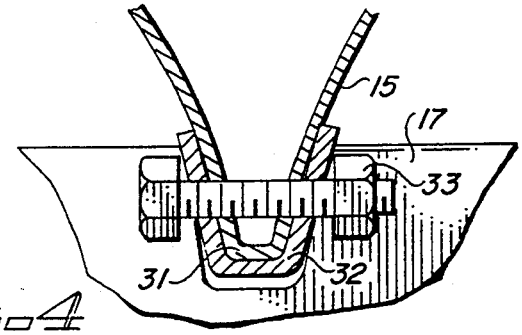
FIG. 4 is an enlarged detail of the area of FIG. 2 encompassed by dot-and-dash circle 4.

In the drawings, the reference numeral 11 designates generally one form of lighting fixture embodying this invention. The fixture 11 is depicted in its entirety in FIG. 1 and FIGS. 2–6 illustrate its details of construction.

The major components of the lighting fixture 11 are an armored housing 12, a first, or inner, reflector structure 13, a lamp 14 and a second, or upper, reflector structure 15.

The functions of the housing 12 are to protect the lamp 14 from missiles or projectiles aimed at the lighting fixture and to provide support for the other components of the fixture. To satisfy the first function, the housing 12 must be able to resist penetration by bullets fired by such common rifle and pistol firearms as the 7.62 NATO, the 5.56 NATO, the 30/06 Winchester, and the 7.62 X39S. To do this, the housing 16 is fabricated from armor plate, preferably a modified chrome moly steel of 500 Burnell REM. Armor plate having a thickness of approximately 0.375 inch is sufficient for most applications.

Housing 12 preferably possesses a body portion 16 having a generally U-shaped cross-section (FIG. 2) and end portions 17. The body portion 16 and the end portions 17 are preferably welded together along their inside seams to leave the housing 12 with a top opening 18.

The body portion 16 of housing 12 may be shaped in a press to the generally U-shaped configuration preferred, but armor plate is extremely difficult to work so it usually is not possible for the inner surface of the body portion to be employed as an efficient reflector of light from the lamp 14. The latter function is performed by the first, or inner, reflector structure 13 which is suspended within the housing 12.

Reflector structure 13 is preferably fabricated from thin sheet metal, such as a stainless steel, having a moderately high quality reflective surface. Reflector structure 13 is configured to have a body 19 having a generally parabolic cross-section (FIG. 2), a forwardly and upwardly sloping front wall 20, and an upright rear wall 21. Rear wall 21 of reflector structure 13 has an opening 22 therein to receive a mounting socket 23 for lamp 14

(FIG. 6). Lamp 14 is thus positioned within and preferably carried by inner reflector structure 13.

To prevent damage to the lamp 14 and the reflector structure 13 from the impact of projectiles against housing 12, the fixture 11 is preferably equipped with means for resiliently supporting the reflector structure 13 and the lamp 14 within the housing. One form of this supporting means is illustrated in FIG. 5 and is indicated generally by reference numeral 24. The resilient supporting means 24 for reflector structure 13 includes a plurality of threaded studs 26 mounted on the inner surface of housing 12 near its top opening 18 (see FIG. 5). Enlarged openings 27 in the upper regions of reflector body 19 permit the wall of the reflector structure to be placed over the studs 26. Regions of the reflector body 19 around openings 27 are sandwiched between elastic rubber or plastic grommets 28 which are clamped tightly against the reflector body 19 by nuts 29 threadably received on the studs 26.

If desired, the lamp mounting socket 23 can be separately supported in the housing 12 by its own resilient support means (not shown), but this arrangement likely will increase the cost of the fixture.

Light from the lamp 14 and reflected light from inner reflector structure 13 are directed upwardly through the top opening 18 in housing 12. Upper reflector structure 15 positioned above housing 12 is designed to reflect this light downwardly and outwardly past the housing 12 and over a large area beneath the fixture 11.

Reflector structure 15 is also preferably formed from sheet metal, such as stainless steel, having a light reflective surface. Reflector structure 15 has a central V-shaped region 21 positioned within a longitudinal channel 32 mounted on the end portions 17 of housing 12. This central region 31 of reflector structure 15 is positioned above the center line of lamp 14 and may be held in place in channel 32 by separable fasteners such as bolts 33 (see FIG. 4).

The degree of dispersement of light from upper reflector structures 15 is determined by the configuration of the two wing-like regions 34 which extend outwardly of the central region 31 and terminate in longitudinal side edges 36. Wing regions 34 of reflective structure 15 preferably have a parabolic cross-section to distribute light evenly over the area to be illuminated. In addition, the front and rear edges of the wing regions 34 may be turned down as indicated at 37 to reflect light that otherwise might escape upwardly and outwardly from the front and rear of reflector structure 15.

It is preferred to stabilize the upper reflector structure 15 on housing 12 by fastening the outer edges of the reflector structure to arm-like extensions 38 of the end portions 17 of housing 12. A suitable separable fastener, such as the stud and nut combination 39, can be employed to fasten the outer edges 36 of reflector structure 15 to each extension 38 (see FIG. 3). Additional rigidity can be imparted to the reflector structure 15 by folding over the sheet metal at the outer edges 36 in the manner shown in FIG. 3.

It is preferable to shield the lamp 14 from moisture which might be blown into the fixture 11 in a rain or snow storm. For this purpose, a tempered glass plate 39 covers the top opening 18 in housing 12. Resilient pads 41 atop the housing 12 isolate the plate 39 from the shock of projectiles impacting the housing. In addition, resiliently padded longitudinal rods 42 at the side edges of the glass plate 39 prevent the plate from being dislodged from the top of the housing 12. Any moisture which does enter housing 12 is allowed to drain there from through an opening 40 in the bottom of the housing (see FIG. 6).

The large exposed area of the upper reflector structure 15 is, of course, susceptible to being hit by projectiles fired at the fixture. The thin sheet structure of reflector 15 allows projectiles to pass cleanly through the reflector surface with little impairment of the efficiency of the fixture. And, the shock of a projectile hitting any portion of the upper reflector structure 15 or its support structures, such as the arm-like extensions 38 and the channel 32, is isolated from the more vulnerable components of the fixture, namely, the lamp 14 and the inner reflector structure 13.

The lighting fixture 11 may be mounted in any suitable manner on a pole or other structure. One such mounting arrangement may employ a pipe 43 welded in an opening in the rear end portion 17 of housing 12. Pipe 43 may also serve as a conduit for electrical wiring 44 for the lamp 14.

Figure 9:
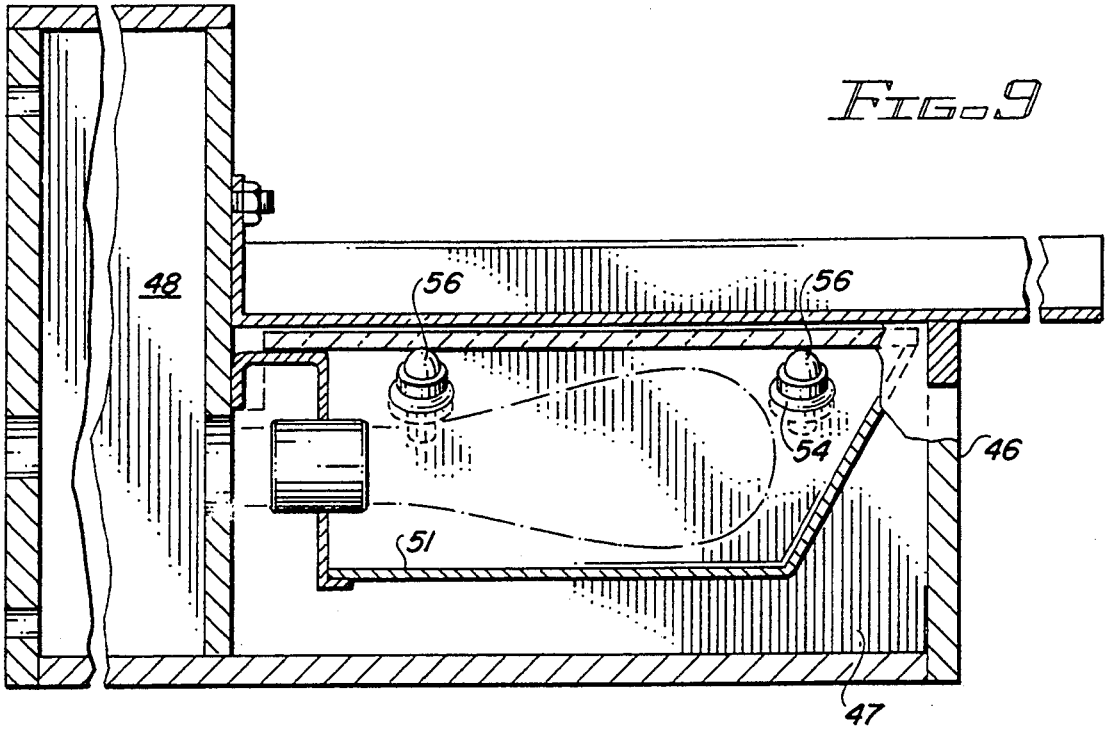
FIG. 9 is a longitudinal sectional view similar to FIG. 6 showing another mode for carrying out the invention.
Figure 10:
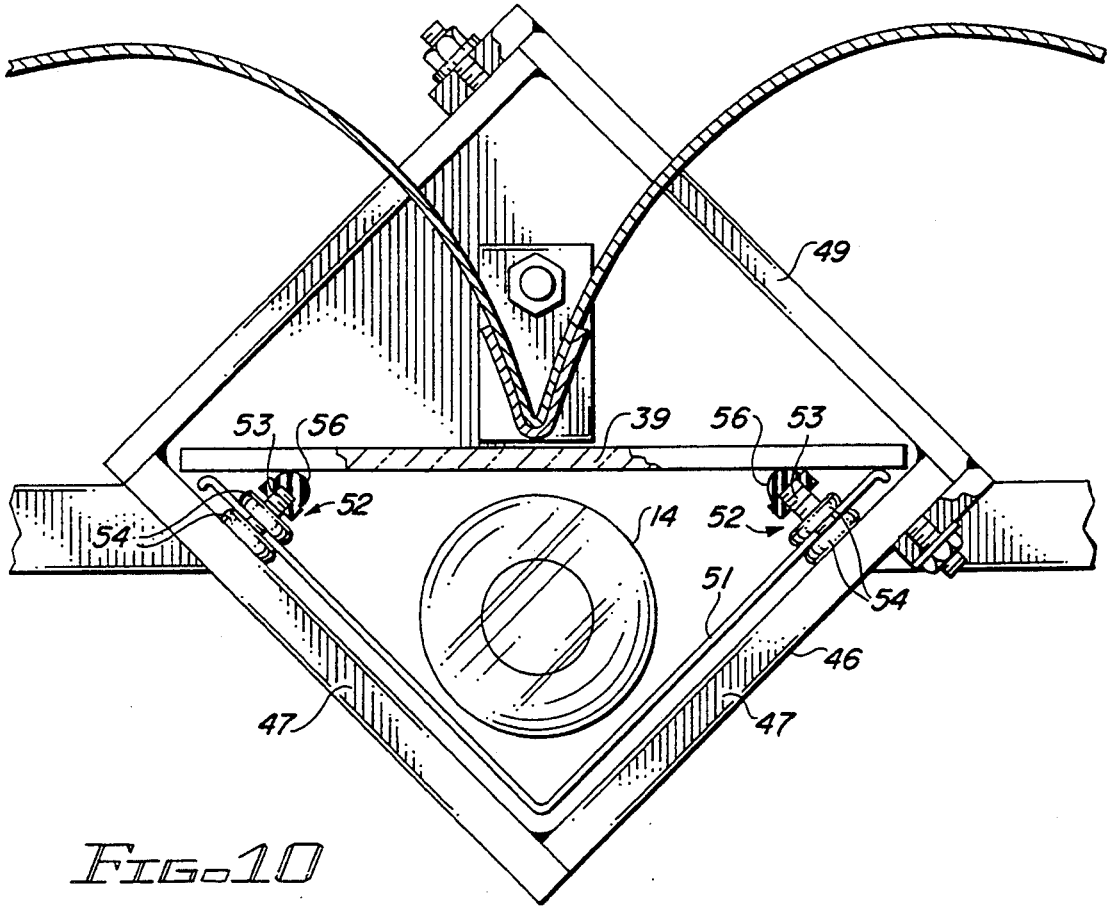
FIG. 10 is a transverse vertical sectional view through the fixture of FIG. 9.

FIGS. 9 and 10 illustrate a modified structure for the armored housing which is identified generally by reference numeral 46. The application for and the function of a lighting fixture employing the modified housing 46 are identical to those discussed above with reference to the fixture illustrated in FIGS. 1–8. A different and possibly less costly fabricating technique is employed for the modified housing 46.

Housing 46 is preferably fabricated from flat pieces of armor plate 47 giving the body of the housing a V-shaped cross section. The housing 46 also is provided with a box-like armored wiring chamber 48 at the rear of the housing. Access to chamber 48 is provided by a removable cover 49 also fabricated from armor plate.

Disposed within the housing 46 is a lamp 14 carried by an inner reflector structure 51 which is fabricated from sheet metal. Means are provided for resiliently supporting reflector structure 51 within the housing 46. This means is indicated generally by reference numeral 52 and includes threaded studs 53 projecting inwardly from the inner surface of housing 46 through openings provided therefor in the reflector structure 51. Positioned on the studs 53 at opposite surfaces of reflector structure 51 are rubber grommets 54. Threaded onto studs 53 are molded plastic cap nuts 56 which provide a cushioned support for glass plate 39.

From the foregoing, it should be apparent that this invention provides an improved, efficient armored lighting fixture capable of reliably illuminating large areas.

What is claimed is:

1. An armored lighting fixture for providing wide-area illumination, said fixture comprising an armored housing formed of armor plate and having a top opening, a first reflector structure positioned in said housing, means for resiliently supporting said first reflector structure in said housing, a lamp positioned in said first reflector structure and carried thereby, said first reflector structure reflecting light from said lamp upwardly through the opening in said housing, and a second reflector structure positioned above said housing for receiving light from said lamp and from said first reflector structure and for reflecting that light downwardly and outwardly past said housing.

2. An armored lighting fixture as defined by claim 1, further comprising a transparent cover for the opening in said housing, and means for resiliently supporting said cover on said housing.

3. An armored lighting fixture as defined by claim 1, further characterized in that said second reflector structure is substantially wider than said housing and has outer edges spaced from said housing, said housing has support means engaging the outer edges of said second reflector structure.

4. An armored lighting fixture as defined in claim 4, further comprising second support means carried by said housing for supporting a region of said second reflector structure between its said outer edges.

5. An armored lighting fixture as defined in claim 2, further characterized in that said second reflector structure has a pair of parabolic configurations extending from a central region thereof upwardly toward the outer edges thereof.

6. An armored lighting fixture as defined by claim 1, further characterized in that said housing has a body portion and a pair of end portions, said body portion being formed from a single plate of armor having a generally U-shaped configuration.

7. An armored lighting fixture as defined by claim 1, further characterized in that said housing has a body portion and a pair of end portions, said body portion and said end portions being fabricated from flat plates of armor.

* * * * *